US007371120B1

(12) United States Patent
Wu et al.

(10) Patent No.: US 7,371,120 B1
(45) Date of Patent: May 13, 2008

(54) MEMORY CARD CONNECTOR

(75) Inventors: Yin-lung Wu, Tu-Cheng (TW); Ming-chiang Chen, Tu-Cheng (TW); Wei-hong Liao, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/808,593

(22) Filed: Jun. 12, 2007

(51) Int. Cl.
*H01R 24/00* (2006.01)

(52) U.S. Cl. ..... 439/636; 439/946

(58) Field of Classification Search ..... 439/629–638, 439/945, 946
See application file for complete search history.

(56) References Cited

U.S. PATENT DOCUMENTS 6,069,795 A * 5/2000 Klatt et al. ..... 361/737
6,097,605 A * 8/2000 Klatt et al. ..... 361/737
6,257,902 B1 * 7/2001 Shieh ..... 439/76.1
7,011,537 B1 * 3/2006 Wu ..... 439/159
7,018,227 B2 * 3/2006 Takahashi ..... 439/347

* cited by examiner

*Primary Examiner*—James Harvey
(74) *Attorney, Agent, or Firm*—Rosenberg, Klein & Lee

(57) ABSTRACT

A memory card connector includes an insulating housing having a base board defining longer cavities thereon. Each longer cavity has a guiding cavity having two first mounting grooves. The guiding cavity extends rearward to form a connecting cavity being wider than the guiding cavity. The bottom of the connecting cavity extends rearward at one side to form a first receiving cavity, and the other side of the connecting cavity extends rearward to form a second receiving cavity. Longer terminals received in the longer cavities have a base portion having two restraining portions protruding from two sides of the base portion. The rear end of the base portion stretches rearward to form a connecting portion wider than the base portion. One side of the connecting portion extends rearward to form a fixed portion, and the other side extends rearward to form a contacting portion spaced away from the fixed portion.

8 Claims, 5 Drawing Sheets

MEMORY CARD CONNECTOR

BACKGROUND OF THE INVENTION

1. Field of the Invention

This invention generally relates to a memory card connector, and more particularly to a memory card connector having improved electric terminals.

2. The Related Art

Recently, more and more compact and multi-functional electronic apparatuses such as digital cameras, mobile phones or the like have been displayed on the market. In order to add a variety of sub-functions, an integrated circuit card is inserted in the electronic apparatus with a built-in CPU or a memory card such as a SIM card, a MMC card, a SD card and so on. Many different kinds of memory card connectors are provided for connecting such cards to the electronic apparatuses.

Conventionally, a memory card connector includes a plurality of commonplace terminals which are located inside terminal slots of the memory card connector respectively for electrically connecting a memory card to an electronic apparatus. The terminal is a slender metallic sheet, and the side of the terminal is mounted in a groove defined in the side of the terminal slot for being located in the memory card connector. However, it can be seen that the commonplace terminals are fabricated in the terminal slots not steadily enough. Therefore, the stability of the connection between the terminals and the memory card is not fine.

SUMMARY OF THE INVENTION

An object of the present invention is to provide a memory card connector having improved electric terminals. The memory card connector includes an insulating housing having a base board. The base board protrudes upward to form three enclosing walls from two side edges and the rear end edge thereof. The enclosing walls and the base board form a first accommodating cavity. The upper surface of the base board defines longer cavities. Each of the longer cavities has a guiding cavity extending from front to rear and communicating with the outside at the front. The guiding cavity protrudes toward two sides to form two first mounting grooves at the front end. The guiding cavity extends rearward to form a connecting cavity and the connecting cavity is wider than the guiding cavity. The bottom of the connecting cavity extends rearward at one side to form a first receiving cavity, so a resisting portion is formed above the first receiving cavity. The other side of the connecting cavity extends rearward to form a second receiving cavity. Longer terminals received in the longer cavities have a base portion received in the guiding cavity and the front of the connecting cavity. The front of the base portion protrudes toward two sides to form a pair of restraining portions received in the first mounting grooves. The front end of the base portion extends downward and then bends forward to form a first soldering portion. The rear end of the base portion stretches rearward to form a connecting portion which is wider than the base portion. The connecting portion is received in the rear of the connecting cavity. One side of the connecting portion extends rearward to form a fixed portion and the other side of the connecting portion extends rearward to form a contacting portion divided from the fixed portion. The fixed portion is received in the first receiving cavity and resisted by the resisting portion. The contacting portion is received in the second receiving cavity and protrudes upward into the first accommodating cavity.

As described above, the design of the memory card connector improves the structure of the longer terminals and accordingly, a new fixing structure is formed in the insulating housing. Therefore, the longer terminal is fixed in the insulating housing more steadily.

BRIEF DESCRIPTION OF THE DRAWINGS

A detailed explanation of a preferred embodiment of the present invention will be given, with reference to the attached drawings, for better understanding thereof to those skilled in the art:

FIG. 6 is a perspective view of the memory card connector with two memory cards inserted in.

DETAILED DESCRIPTION OF THE PREFERRED EMBODIMENT

Figure 1:
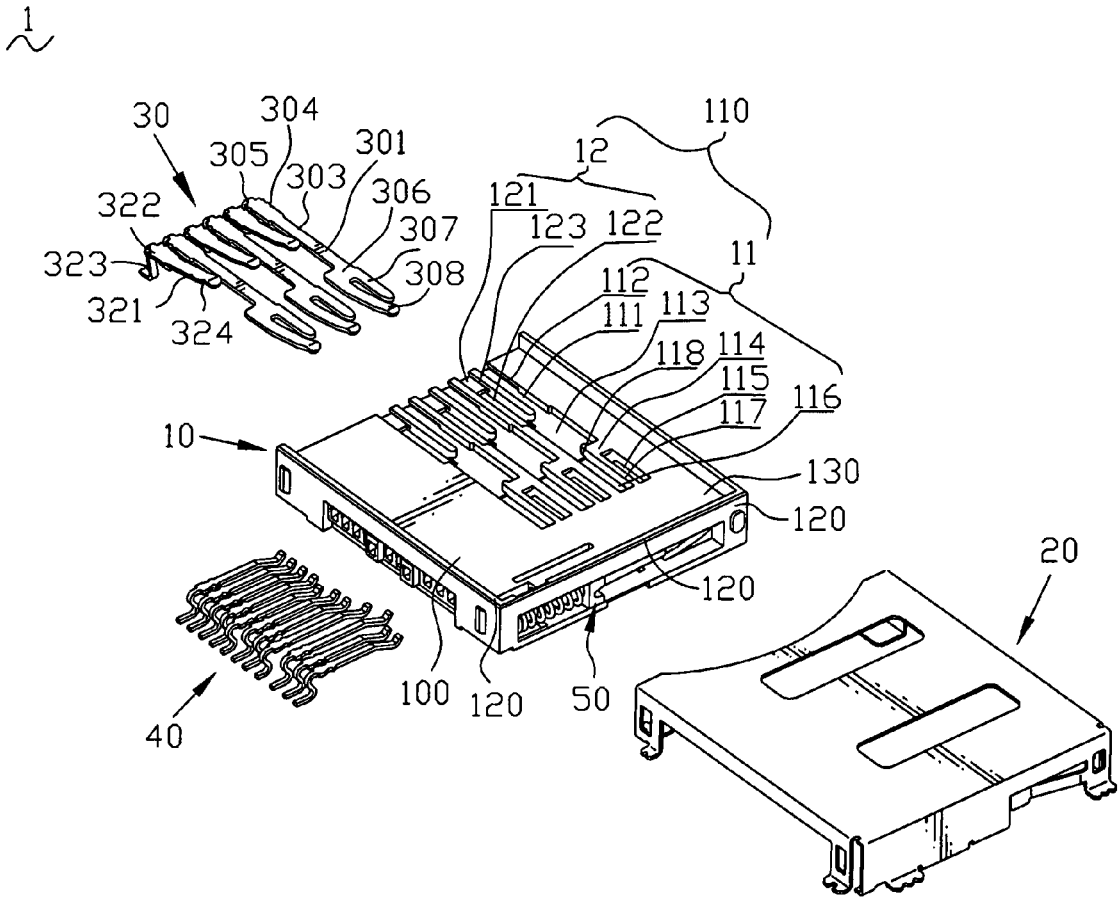
FIG. 1 is an exploded view of a memory card connector in accordance with the present invention.

Referring to FIG. 1, a memory card connector 1 according to the present invention includes an insulating housing 10, an upper cover 20 coupling with the insulating housing 10, a first group of electric terminals 30 and a second group of electric terminals 40 for connecting with two different memory cards respectively, as well as an ejecting mechanism 50 for guiding the memory card to be inserted in or ejected. All of these will be respectively described in detail hereinafter.

Figure 2:
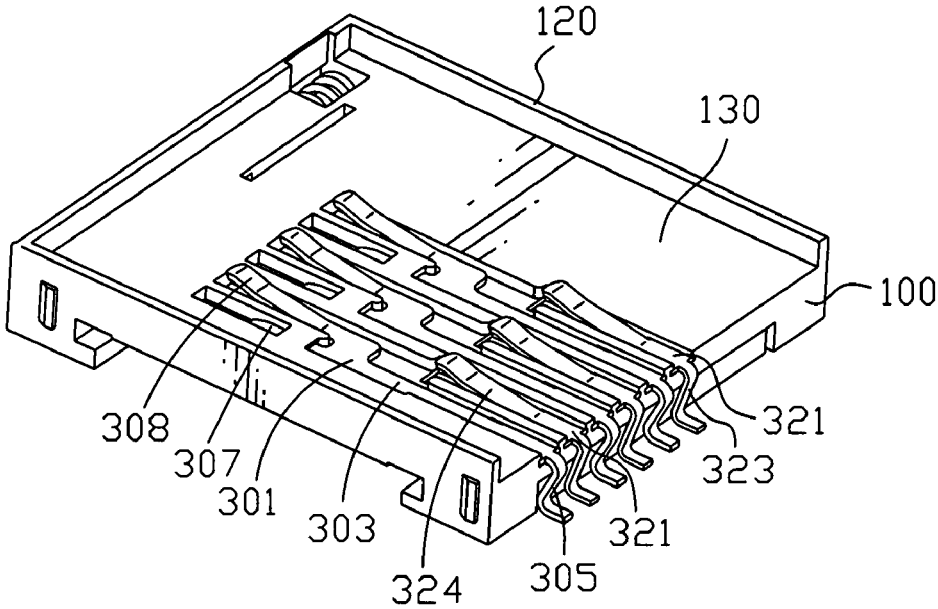
FIG. 2 is a perspective view of the memory card connector without an upper cover.
Figure 6:
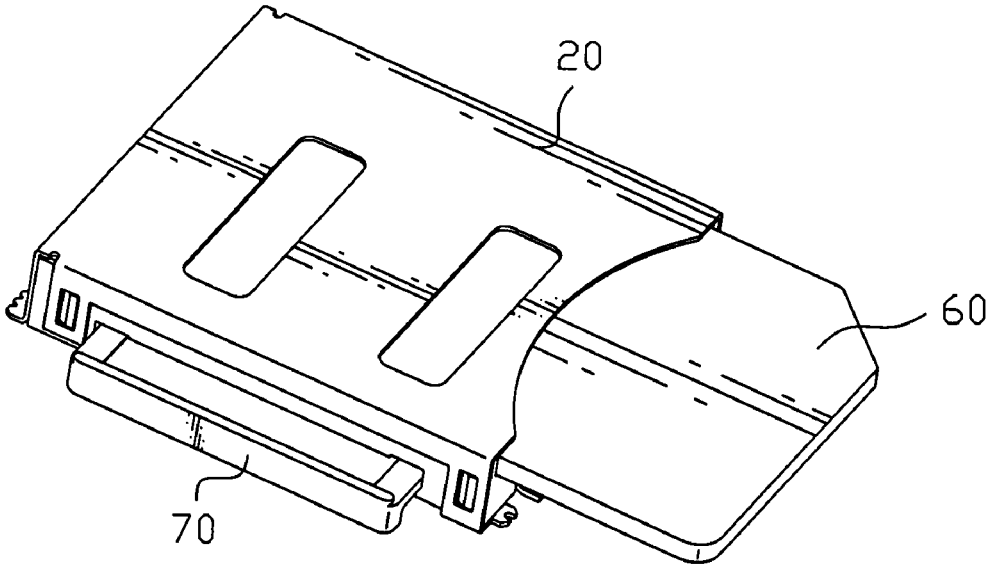

With reference to FIG. 1 and FIG. 2, the insulating housing 10 is in substantially rectangular shape and includes a base board 100. The base board 100 protrudes upward to form three enclosing walls 120 from two side edges and the rear end edge thereof. The enclosing walls 120 and the base board 100 form a first accommodating cavity 130 to receive a first memory card 60 (as shown in FIG. 6). The upper surface of the base board 100 defines a first group of terminal cavities 110. The first group of the terminal cavities 110 defines the inserting direction of the first memory card 60. The first group of the terminal cavities 110 has a plurality of longer cavities 11 and a plurality of shorter cavities 12. The longer cavities 11 and the shorter cavities 12 are arranged interlacedly. Each of the longer cavities 11 includes a long and narrow guiding cavity 111 extending from front to rear and communicating with the outside at the front. The bottom of the guiding cavity 111 protrudes toward two sides to form a pair of first mounting grooves 112 at the rear end. The guiding cavity 111 extends rearward to form a connecting cavity 113. The connecting cavity 113 simultaneously extends toward both sides of the base board 100, and so is wider than the guiding cavity 111. The bottom of the connecting cavity 113 extends rearward at one side to form a first receiving cavity 115, so a resisting portion 114 is formed above the first receiving cavity 115. The front of the first receiving cavity 115 upward passes through the resisting portion 114. The other side of the connecting cavity 113 extends rearward to form a second receiving cavity 116, and a separating beam 117 is formed between the two receiving cavities 115, 116. The bottom of the front end of the separating beam 117 is hollowed to form a fixing cavity 118. The shorter cavity 12 is at the front of the connecting cavity 113 and is opposite to the second receiving cavity 116. The shorter cavity 12 includes a first recess 121 and a second recess 122. The bottom of the first recess 121 protrudes toward two sides to form a pair of second mounting grooves 123. The first recess 121 extends rearward to form the second recess 122 which hollows downward slightly. The rear end of the second recess 122 is blocked by a barricade which separates the shorter cavity 12 from the connecting cavity 113 of the longer cavity 11.

Figure 3:
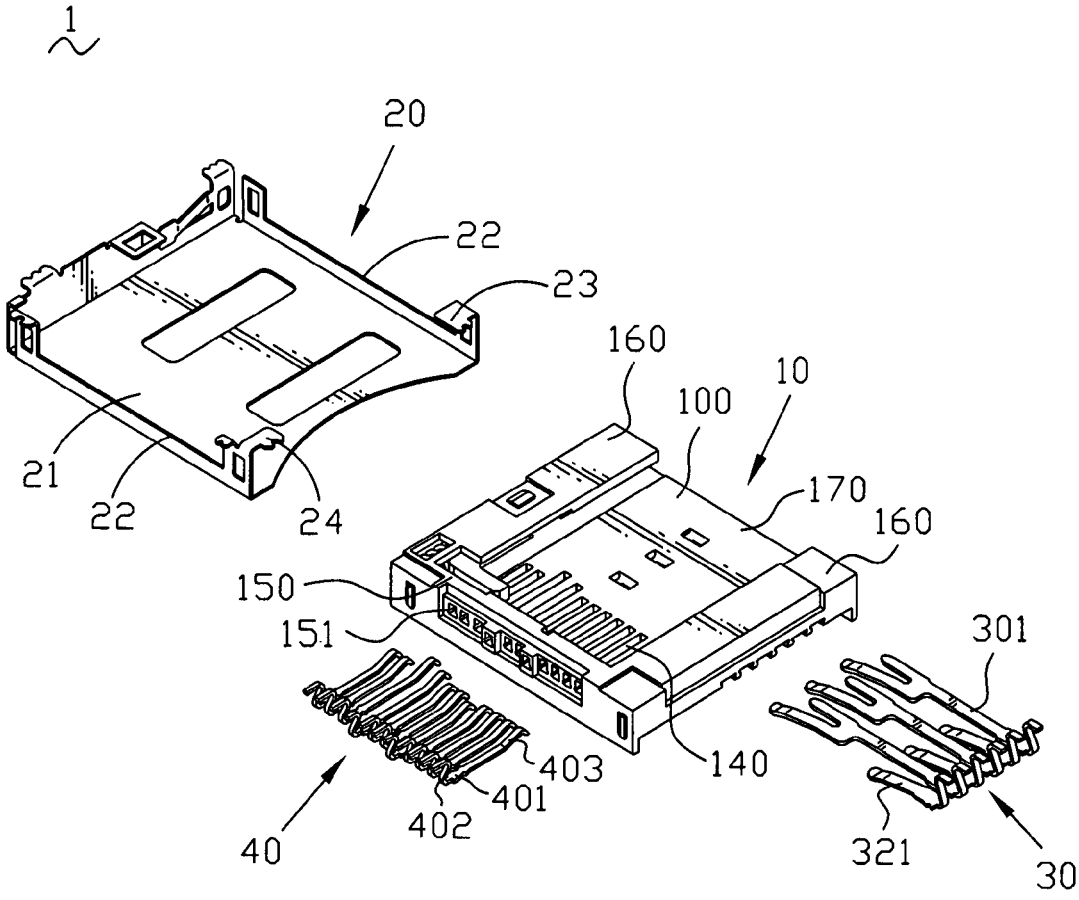
FIG. 3 is another exploded view of the memory card connector for showing the reverse side of the memory card connector.
Figure 4:
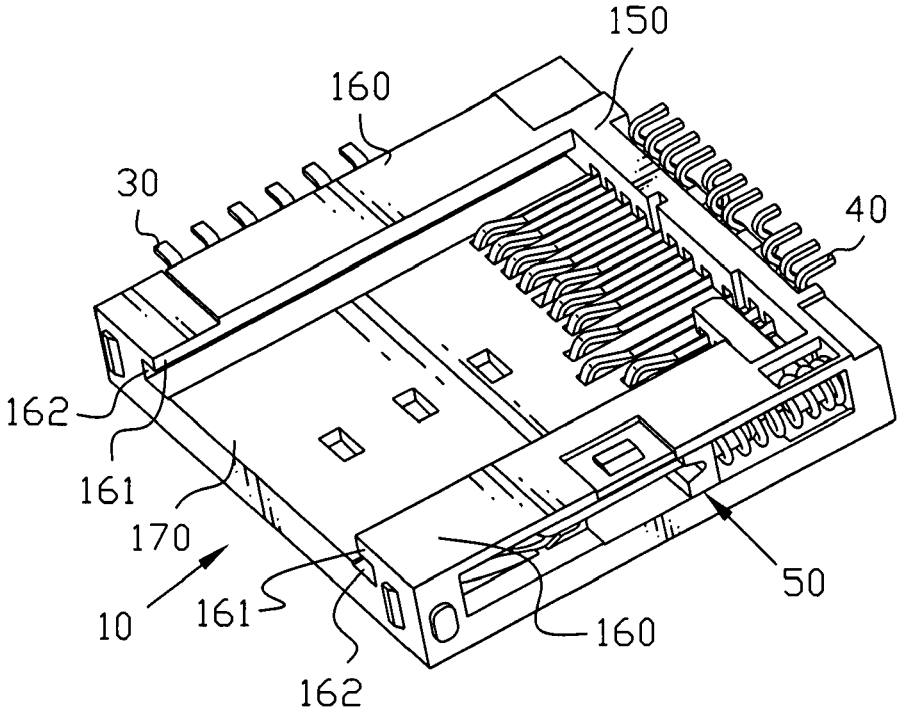
FIG. 4 is another perspective view of the memory card connector without the upper cover for showing the reverse side of the memory card connector.

Referring to FIGS. 3-4, the reverse surface of the base board 100 defines a second group of terminal cavities 140 perpendicular with the first group of the terminal cavities 110. The second group of the terminal cavities 140 defines the inserting direction of a second memory card 70 (shown in FIG. 7). The side edges of the base board 100 extend downward to form a preventing wall 150 perpendicular with the second terminal cavities 140 and two clipping walls 160 parallel with the second terminal cavities 140. The preventing wall 150 defines a plurality of passages 151 connecting with the second group of the terminal cavities 140 respectively. The preventing wall 150, the two clipping walls 160 and the base board 100 form a second accommodating cavity 170 therebewteen for receiving the second memory card 70. The bottom of the clipping wall 160 protrudes inward to form a supporting arm 161. The base board 100 defines two sliding grooves 162 adjacent to the clipping walls 160 and above the supporting arms 161.

Figure 5:
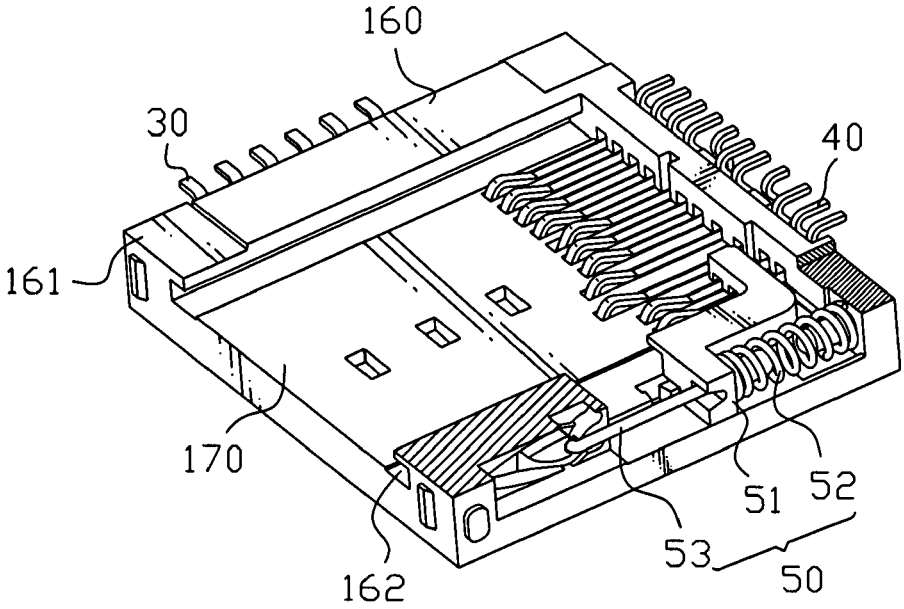
FIG. 5 is a cross-sectional view of the memory card connector shown in FIG. 4 for distinctly showing an ejecting mechanism of the memory card connector.

Referring to FIG. 5, one of the clipping walls 160 is provided with an ejecting mechanism 50 for inserting in or ejecting the second memory card 70. The ejecting mechanism 50 includes a sliding body 51, a spring 52 and a connecting shaft 53. Thereinto, the construction of the ejecting mechanism 50 is known to those skilled in the art, so it will not be introduced anymore.

Referring to FIG. 1 again, the first group of the electric terminals 30 includes a plurality of longer terminals 301 and a plurality of shorter terminals 321. The longer terminal 301 which is received in the longer cavity 11 has a base portion 303. The front of the base portion 303 protrudes toward two sides to form a pair of restraining portions 304. The front end of the base portion 303 extends downward and then bends forward to form a first soldering portion 305. The rear end of the base portion 303 stretches rearward to form a short connecting portion 306. The connecting portion 306 is wider than the base portion 303. One side of the connecting portion 306 extends rearward to form a fixed portion 307. The other side of the connecting portion 306 extends rearward and tilts upward a bit to form a first contacting portion 308 spaced away from the fixed portion 307.

The shorter terminal 321 which is received in the shorter cavity 12 has a locating portion 322. The front end of the locating portion 322 bends downward and then stretches forward to form a second soldering portion 323. The rear end of the locating portion 322 extends rearward and tilts upward a bit to define a second contacting portion 324. The second contacting portion 324 is narrower than the locating portion 322. The front end of the second contacting portion 324 is bent downward a bit.

Referring to FIG. 3 again, the second electric terminal 40 includes a mounting portion 401. One end of the mounting portion 401 bends downward and then stretches in an opposite direction of the mounting portion 401 to form a welding portion 402. The other end of the mounting portion 401 extends in a constant direction to define a touching portion 403 which is narrower than the mounting portion 401.

The upper cover 20 has a board-shaped ceiling 21. Two opposite lateral sides of the ceiling 21 extend downward to form two sidewalls and each sidewall has a notch 22 therethrough. Both fronts of the sidewalls downwardly extend and terminate in an inwardly extended retaining blocks 23, 24.

Referring to FIGS. 2 and 4, in assembly, the first group of the electric terminals 30 is embedded in the first group of the terminal cavities 110 respectively. At beginning, the fixed portion 307 is placed in the connecting cavity 113. When the assembly is completed, the fixed portion 307 is pushed rearward into the first receiving cavity 115 and resisted by the resisting portion 114. The first contacting portion 308 is received in the second receiving cavity 116 and protrudes upward into the first accommodating cavity 130. The connecting portion 306 is received in the rear of the connecting cavity 113 and fixed in the fixing cavity 118. The base portion 303 is received in the guiding cavity 111 and the front of the connecting cavity 113. The restraining portion 304 is located in the first mounting groove 112, and the first soldering portion 305 stretches out of the longer cavity 11. The shorter terminals 321 are inlayed in the shorter cavities 12 with the second contacting portion 324 received in the second recess 122 and protruding upward into the first accommodating cavity 130. The rear end of the second contacting portion 324 is blocked by the barricade. The locating portion 322 is fixed in the first recess 121 in the second mounting grooves 123. The second soldering portion 323 stretches out of the shorter cavity 12. The second group of the electric terminals 40 is received in the second group of the terminal cavities 140. The welding portion 402 passes through the passage 151 of the preventing wall 150. The upper cover 20 glidingly receives the insulating housing 10 and is over the first accommodating cavity 130. The notches 22 face to the second group of the terminal cavities 140 and the retaining blocks 23, 24 are received in two bottom ends of the clipping wall 160 opposite to the other clipping wall 160 receiving the ejecting mechanism 50.

Figure 7:
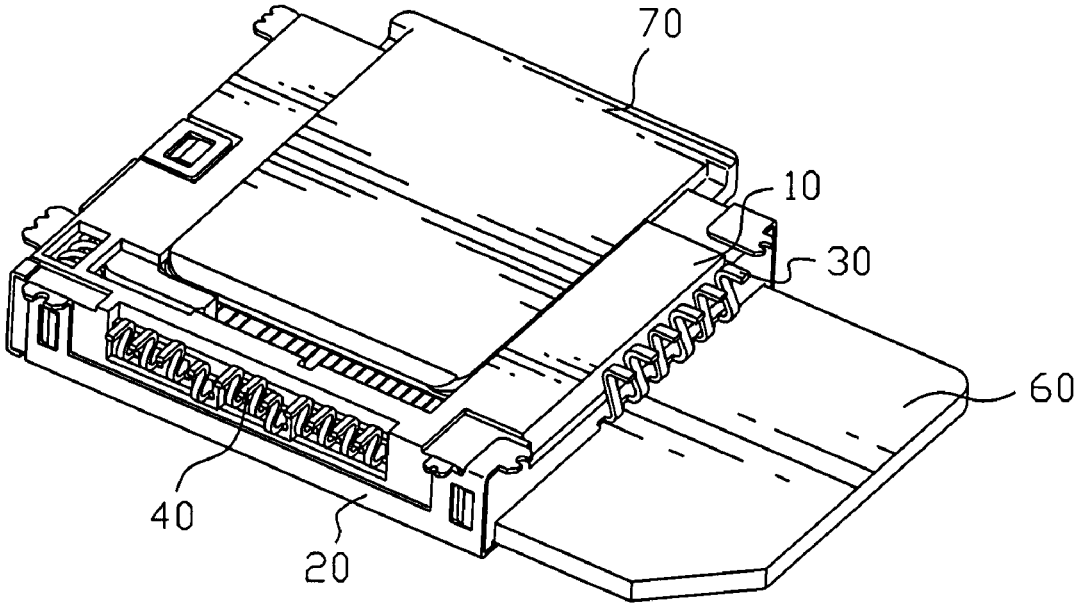
FIG. 7 is another angle perspective view of FIG. 6 for showing the reverse side the memory card connector.

Please refer to FIG. 6 and FIG. 7. The first memory card 60 is inserted in the first accommodating cavity 130 along the inserting direction thereof, and the electric pads of the first memory card 60 get contact with the first group of the electric terminals 30. The second memory card 70 is inserted in the second accommodating cavity 170 along the sliding groove 162 and is supported via the supporting arms 161. The electric pads of the second memory card 70 get contact with the second group of the electric terminal 40 for electrically connecting with an external apparatus.

As mentioned above, the design of the memory card connector 1 improves the structure of the first group of the electric terminals 30, and accordingly, a new fixing structure is formed in the insulating housing 10. Therefore the first group of the electric terminal 30 is fixed in the insulating housing 10 more steadily.

Although preferred embodiment of the present invention have been described in detail hereinabove, it should be clearly understand that many variations and/or modifications of the basic inventive concepts herein taught which may appear to those skilled in the present art will fall within the spirit and scope of the present invention, as defined in the appended claims.

What is claimed is:

1. A memory card connector comprising:

an insulating housing, having a base board, the base board protruding upward to form three enclosing walls from two side edges and a rear end edge thereof, the enclosing walls and the base board forming a first accommodating cavity, an upper surface of the base board defining longer cavities, each of the longer cavities having a guiding cavity extending from front to rear and communicating outside of the cavity at the front, a bottom of the guiding cavity protruding toward two sides to form two first mounting grooves at a front end, the guiding cavity extending rearward to form a connecting cavity, the connecting cavity being wider than the guiding cavity, a bottom of the connecting cavity extending rearward at one side to form a first receiving cavity, a resisting portion being formed above the first receiving cavity, another side of the connecting cavity extending rearward to form a second receiving cavity; and longer terminals received in the longer cavities, each of the longer terminals having a base portion, a front of the base portion protruding toward two sides to form a pair of restraining portions, a front end of the base portion extending downward and then bending forward to form a first soldering portion, a rear end of the base portion stretching rearward to form a connecting portion wider than the base portion, one side of the connecting portion extending rearward to form a fixed portion, another side of the connecting portion extending rearward to form a contacting portion spaced away from the fixed portion;

wherein the fixed portion is received in the first receiving cavity and resisted by the resisting portion, the contacting portion received in the second receiving cavity and protruding upward into the first accommodating cavity, the connecting portion received in a rear of the connecting cavity, the base portion received in the guiding cavity and a front of the connecting cavity, the restraining portion received in the first mounting groove.

2. The memory card connector as claimed in claim 1, wherein the rear of the first receiving cavity upward passes through the resisting portion.

3. The memory card connector as claimed in claim 1, wherein the insulating housing has a separating beam formed between the first receiving cavity and the second receiving cavity.

4. The memory card connector as claimed in claim 3, wherein the bottom front end of the separating beam is hollowed to form a fixing cavity for fixing the connecting portion of the longer terminal.

5. The memory card connector as claimed in claim 1, wherein the insulating housing further defines shorter cavities for receiving shorter terminals, the longer cavities and the shorter cavities are arranged interlacedly, the shorter cavity is at the front of the connecting cavity and is opposite to the second receiving cavity.

6. The memory card connector as claimed in claim 5, wherein the shorter cavity includes a first recess and a second recess, the first recess protrudes toward two sides to form two second mounting grooves, the first recess extends rearward to form the second recess which hollows downward slightly.

7. The memory card connector as claimed in claim 5, wherein the shorter terminal has a locating portion, the front end of the locating portion bends downward and then stretches forward to form a second soldering portion, the rear end of the locating portion extends rearward and tilts upward a bit to define a second contacting portion, the second contacting portion is narrower than the locating portion.

8. The memory card connector as claimed in claim 1, wherein the insulating housing is coupled with an upper cover having a ceiling, two opposite lateral sides of the ceiling extend downward to form two sidewalls, both fronts of the sidewalls downwardly extend and terminate in an inwardly extended retaining blocks.

* * * * *